United States Patent [19]

McDermott

[11] 4,245,481

[45] Jan. 20, 1981

[54] SUPPLEMENTAL COLD-AIR SUPPLY SYSTEM

[76] Inventor: Raymond J. McDermott, 4725 Clippert, Dearborn Heights, Mich. 48125

[21] Appl. No.: 91,059

[22] Filed: Nov. 5, 1979

[51] Int. Cl.[3] ..... F25D 17/08

[52] U.S. Cl. ..... 62/187; 62/180; 62/411; 98/33 R; 236/49

[58] Field of Search ..... 62/410–412, 62/180, 203, 186, 187; 98/32, 33 R; 236/49

[56] References Cited

U.S. PATENT DOCUMENTS

| | | | |
|---|---|---|---|
| 1,868,933 | 7/1932 | Veilleux | 62/412 X |
| 3,158,082 | 11/1964 | Dillingham et al. | 98/33 R |
| 4,023,947 | 5/1977 | Ferry | 62/180 |
| 4,147,038 | 4/1979 | Hoebing et al. | 62/412 X |
| 4,175,401 | 11/1979 | McManus | 62/412 X |

*Primary Examiner*—William E. Tapolcai, Jr.
*Attorney, Agent, or Firm*—Cullen, Sloman, Cantor, Grauer, Scott & Rutherford

[57] ABSTRACT

A supplemental cold air supply unit is disclosed which is incorporated into an existing refrigeration enclosure for supplying cooler ambient air to the refrigeration enclosure when the outside air is at a lower temperature than the air temperature within the enclosure. The cold air supply unit comprises a housing which includes a blower fan and a coaxial pipe assembly for cold air inlet and warm air exhaust. Outside and inside thermostats determine when the outside air is at or below the temperature of the air within the enclosure to turn the blower fan on for cooling the refrigeration enclosure when appropriate. The cold air from the outside is exhausted into the refrigeration enclosure through a shuttered opening in the housing, and warm air within the enclosure is returned to the housing through a separate warm air opening for exhaust through the coaxial pipe assembly. The warm air opening includes a door which is opened by means of a cam mechanism and motor electrically connected to the control circuit for the cold air supply unit. When the outside air is at or below the temperature of the air within the enclosure, the outside and inside thermostats turn the blower fan on and cold air is blown into the enclosure for cooling its contents, and simultaneously therewith, the existing refrigeration equipment is turned off in order to conserve energy.

2 Claims, 4 Drawing Figures

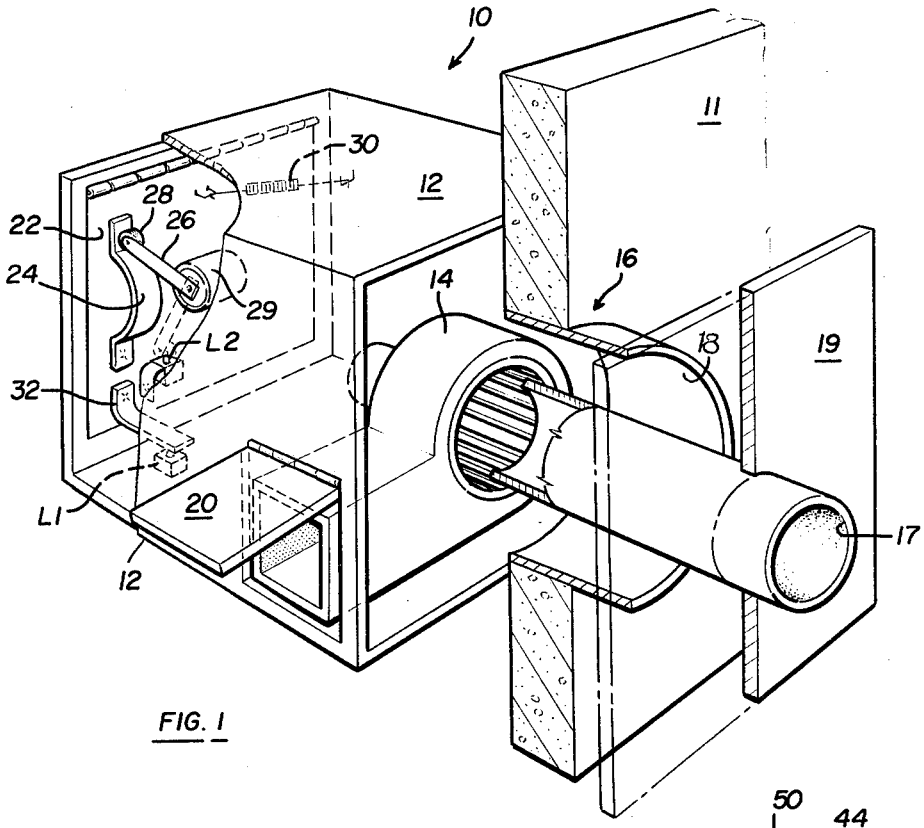
FIG. 1
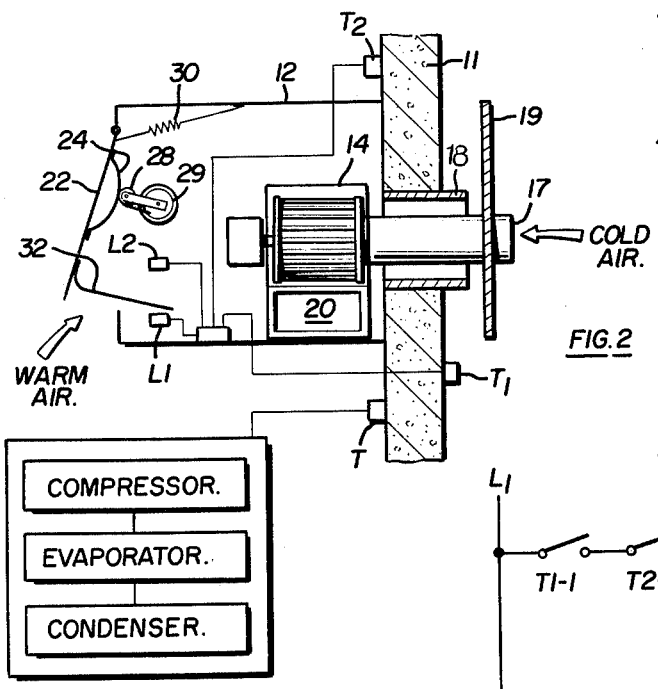
FIG. 2
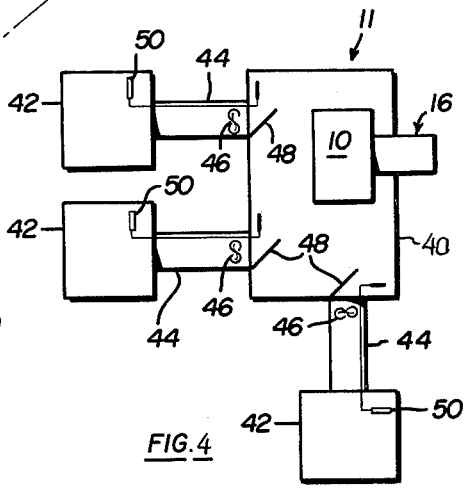
FIG. 4
FIG. 3
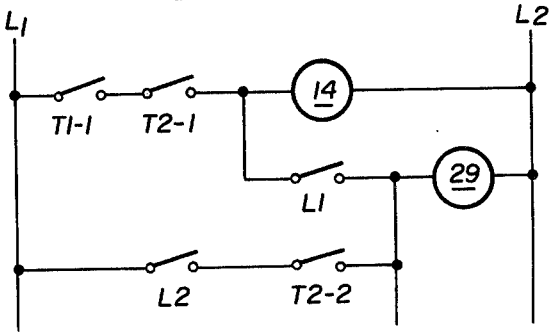

SUPPLEMENTAL COLD-AIR SUPPLY SYSTEM

BACKGROUND OF THE INVENTION

The present invention relates to a device for supplying cooler outside ambient air to a refrigerator enclosure when the outside air is at a lower temperature than the air temperature within the closure.

In conventional refrigerator apparatus, power operated means including a compressor, evaporator, and condenser are used for controlling the temperature within the cooled refrigerator compartment. Such power operated refrigeration equipment consumes an enormous amount of power even though many of the existing refrigeration units operate at temperatures above freezing. Thus, there has been a need for supplemental type systems which can be easily and inexpensively combined with conventional refrigerating equipment to reduce the work load on such equipment.

Several attempts have been made to combine a supplemental system with conventional refrigerating equipment. Some examples of the prior art supplemental systems are found in U.S. Pat. Nos. 2,855,839, 2,488,518, and 4,023,947. These prior art patents disclose that outside ambient air can be used to supplement the operation of the refrigeration equipment when the outside air temperature is equal to or below that required within the refrigeration enclosure.

A problem with the prior art constructions is that they are expensive and not easily incorporated into existing refrigeration equipment. Further, some of the supplemental supply systems are slow to react or reduce the flow of cold air into the enclosure which may cause damage to the goods. The rate of air flow from the outside must be controlled depending on the temperature difference between the outside ambient air and the temperature inside the enclosure. Thus, there has been a need for a supplemental supply unit which can be combined with an existing refrigeration enclosure to provide air flow into the enclosure when the outside air temperature is equal to or below the air temperature within the enclosure.

The dissadvantage of present supplemental systems for refrigeration equipment have resulted in the cold air supply system of the present invention which substantially reduces the work load on the refrigeration equipment and results in substantial savings in energy and expense.

SUMMARY OF THE INVENTION

In accordance with the present invention, a cold air supply system is provided which supplies cooler outside ambient air into a refrigerator enclosure when the outside air is at a lower temperature than the air temperature within the enclosure.

The present supplemental cold air supply unit comprises a box-like housing which includes a blower fan and a coaxial pipe assembly for cold air inlet and warm air exhaust. The housing can be conveniently fastened either inside the existing refrigerator enclosure or outside the enclosure depending on the amount of available space. The housing is vented to the outside by means of a warm air exhaust pipe which is concentric with and surrounds the cold air supply pipe so that only one opening need be cut through the roof or wall of the existing refrigerator enclosure to install the unit.

A temperature sensing device, such as a thermostat, on the outside of the building determines when the outside air is cold enough to act as a refrigeration medium. When the outside air is at or below the temperature of the air within the enclosure, the thermostat turns the blower fan on, and cold air is sucked into the housing and blown into the refrigeration cabinet for cooling the contents. Simultaneously therewith, the existing refrigeration equipment is turned off in order to save energy.

An inside thermostat within the refrigeration enclosure also controls the blower so that the blower does not blow cold air into the enclosure when the air inside the enclosure is already suitably cold. In normal operation, such as during the summertime, the existing refrigeration equipment keeps the enclosure cool as is usual. in the winter months or during colder weather, the inside thermostat within the enclosure senses the need for cooling, and the outside thermostat senses that the ambient air is at a temperature that can be used for cooling. Thus, when the temperature within the enclosure rises to a certain pre-determined level and the outside air temperature is below that predetermined level, then the blower is activated and the normal refrigeration equipment is turned off.

The supplemental cold air supply unit is not electrically connected to the existing refrigeration equipment but operates independently of it. The normal thermostat for the refrigeration equipment is located in the enclosure for operating the refrigeration equipment when needed. A new thermostat is mounted outside the enclosure and is connected in series with a new thermostat mounted inside the enclosure. The outside thermostat detects ambient air temperature and the inside thermostat determines the need for cold air regardless of whether it is cold air from the outside or cold air from the refrigeration equipment. Thus, the present unit does not require modification of the existing refrigeration equipment because the series connection between the outside thermostat and inside thermostat provides a simple electrical connection which does not require complex electrical controls or any changes in the existing refrigeration equipment.

The cold air from the outside is exhausted through a shuttered opening in the cold air supply housing which swings open because of the air pressure from the blower. Warm air in the enclosure returns to the cold air supply housing through a separate door in the housing and exhausts through the coaxial inlet-exhaust pipe assembly. As an alternate embodiment, the blower may not be needed when the outside air temperature is very cold (i.e., during the winter). In that case, a separate solenoid can be used to open the shuttered opening in the cold air supply housing to bring in the outside cold air by natural convection without turning the blower on. That is, the air will come in through the blower pipe, around the blower vanes and into the refigeration enclosure through the shuttered door.

The warm air in the enclosure returns to the cold air supply housing through a separate hinged door and exhausts through the warm air exhaust pipe. The separate door is opened by means of a cam follower made of a strip of bent metal fastened to the door and a cam arm having a roller that rides the cam follower and pushes the door outwardly. The cam arm is connected to a motor which causes the arm to rotate and thereby move the cam follower outwardly. For closing the door, the motor completes its revolution which permits a spring, which is attached to the door, to return the door to its closed position.

The present supplemental cold air supply system operates as follows. When the outside temperature drops to approximately 38° F. or below, the outside thermostat closes. If the inside temperature of the refrigeration enclosure rises above 38° F., the inside thermostat closes thereby permitting the blower to run and also opening the warm air hinged door to its maximum position. When the temperature inside the refrigeration enclosure drops to approximately 36° F., the inside thermostat shuts off the blower and also closes the warm air hinged door. The power demand for the cold air supply system of the present invention is considerably less than the existing refrigeration equipment. This provides a substantial savings in energy and expense.

Other advantages and meritorious features of the supplemental cold air supply system of the present invention will be more fully understood from the following description of the preferred embodiment, the appended claims and the drawings, a brief description of which follows.

BRIEF DESCRIPTION OF DRAWINGS

FIG. 1 is a perspective view of the supplemental cold-air supply system of the present invention illustrating its assembly.

FIG. 2 is a side elevational view of the cold air supply system installed in a side wall or roof of an existing refrigeration enclosure.

FIG. 3 is a schematic illustration of the control circuit for the cold air supply system.

FIG. 4 is a schematic illustration of an alternate embodiment wherein the cold air supply system of the present invention supplies cold air to a number of satellite cooling enclosures.

DESCRIPTION OF THE PREFERRED EMBODIMENT

A preferred embodiment of the supplemental cold air supply system made in accordance with the teachings of the present invention is illustrated in FIGS. 1-3. The cold air supply system 10 is illustrated as being installed in the wall 11 of a conventional refrigeration enclosure. It may also be mounted to pull in cold air through the roof of the refrigeration enclosure. The cold air supply system 10 supplies cooler outside ambient air into the refrigeration enclosure when the outside air is at a lower temperature than the air temperature within the enclosure.

It will be noted that the refrigeration enclosure is normally cooled by a conventional mechanical refrigeration system including a compressor, evaporator, and condensor as illustrated in FIG. 2. The power operated refrigeration system operates in response to thermostat T which is mounted within the enclosure to monitor the temperature therein.

The supplemental cold air supply unit 10 comprises a box-like container or housing 12 which includes a blower fan 14 and a coaxial pipe assembly 16. The cold air supply unit 10 can be conveniently fastened either inside the existing refrigeration enclosure or outside the enclosure depending on the amount of available space. The housing is vented to the outside by means of a warm air exhaust 18 which is concentric with and surrounds the cold air supply pipe 17 so that only one hole need to be cut through the wall 11 or roof of the existing refrigeration enclosure.

The coaxial pipe assembly 16 provides an advantage over prior constructions in that only one opening is necessary to install the cold air supply unit. Cold air is sucked into blower 14 through pipe 17, and warm air is exhausted from the enclosure through concentric pipe 18. The exhausted warm air is deflected by shield 19 away from the cold air inlet. Thus, pipe assembly 16 provides a simple connection so that the cold air supply unit may be installed in an existing refrigeration enclosure without modifying the enclosure except for cutting an opening for the pipe assembly.

A temperature sensing device, such as thermostat $T_1$, on the outside of the refrigeration enclosure determines when the outside air is cold enough to act as a refrigeration medium. When the outside air is at or below the temperature of the air within the enclosure, the thermostat $T_1$ turns the blower 14 on and cold air is blown into the refrigeration enclosure for cooling the contents. Simultaneously therewith, the existing refrigeration equipment is turned off in order to save energy.

Thermostat $T_2$ also controls the blower 14 so that the blower does not blow cold air into the enclosure when the air inside the enclosure is already suitably cold. In normal operation, the existing refrigeration equipment keeps the enclosure cool, but in the winter months or during colder weather, thermostat $T_2$ senses the need for cooling, and the outside thermostat $T_1$ senses that the ambient air is at a temperature that can be used for cooling. Thus, when the temperature within the enclosure rises to a certain pre-determined level and the outside air temperature is below that pre-determined level, then the blower 14 is activated and the normal refrigeration equipment is turned off.

The supplemental cold air supply unit 10 is not electrically connected to the existing refrigeration equipment but operates independently of it. Outside thermostat $T_1$ is connected in series with inside thermostat $T_2$. The outside thermostat detects ambient air temperature and the inside thermostat determines the need for cold air regardless of whether it is cold air from the outside or cold air from the refrigerator equipment. Thus, the present cold air supply unit does not require modification of the existing refrigeration equipment because the series connection between the outside thermostat and the inside thermostat is a simple electrical connection which does not require complex electrical controls or any changes in the existing refrigeration equipment. Thermostat $T_2$ is set to operate at approximately 1° F. less than thermostat T so that when blower 14 is activated, the normal refrigeration equipment is turned off thereby saving energy.

The cold air from the outside entering through cold air pipe 17 is exhausted through shuttered opening 20 which swings open because of the air pressure from the blower 14. Warm air in the enclosure returns to the housing 12 through a separate door 22 and exhausts through coaxial exhaust pipe 18.

When the outside air temperature is very cold (i.e., during the winter months), blower 14 may not be needed. In that case, a solenoid (not shown) can be used to open the shuttered door 20 in the housing 12 to bring in the outside cold air by natural convection without the blower being operated. That is, the air will come in through inlet pipes 17, around the blower vanes, and into the refrigeration enclosure through the shuttered door 20. A separate manual control switch (not shown) may be used to actuate the solenoid to open door 20 thereby permitting cold air to enter the refrigeration enclosure without operating blower 14.

The warm air in the refrigeration enclosure returns to container 12 through hinged door 22 and exhausts as previously discussed. Door 22 is opened by means of a cam follower 24 made of a strip of bent metal fastened to the door and cam arm 26 having a roller 28 that rides the cam follower and pushes the door outwardly. The cam arm 26 is connected to a motor 29 which causes the arm to rotate and thereby move the cam follower 24 outwardly. For closing the door, the motor completes its revolution clockwise which permits a spring 30 to return the door to its closed position.

As is illustrated in FIG. 2, a limit switch $L_2$ is provided for stopping door motor 29 when door 22 is closed. A second limit switch $L_1$ is provided to stop motor 29 when the door is opened to its maximum position. Control arm 32 breaks limit $L_1$ thereby stopping door motor 29 and leaving door 22 open to its maximum position for exhausting warm air during the operation of the cold air supply unit 10.

Referring to FIG. 3, the operation of the supplemental cold air supply system is as follows. When the cold air supply system 10 is non-operational and door 22 is closed, Limit switch $L_1$ is closed and limit switch $L_2$ is open. When the outside ambient air temperature drops to 38° F. or below, the outside thermostat $T_{1-1}$ closes. If the inside air temperature rises above 38° F., the inside thermostat $T_{2-1}$ closes thereby turning on blower 14 and door motor 29 which closes limit switch $L_2$. When the side door 22 opens to its maximum position, control arms 32 on the door breaks limit $L_1$ thereby stopping the door motor and leaving the door 22 open during operation. When the air temperature inside the refrigeration enclosure drops to 38° F., inside thermostat $T_{2-2}$ closes thereby permitting door motor 29 to continue its revolution until cam arm 26 breaks limit $L_2$ thereby stopping door motor 29 and leaving door 22 closed completely. Simultaneously therewith, thermostat $T_{2-1}$ opens and shuts off blower 14. Thus, the present cold air supply system supplies cooler outside ambient air into the refrigeration enclosure only when the outside air is at or below the temperature of the air within the enclosure.

As discussed, an optional electrical toggle switch (not shown) can be installed to manually operate a solenoid (not shown) for opening either door 22 or door 20 when the outside ambient temperature is 38° F. or below. This provides the unit with increased efficiency because it may not be necessary to run the blower 14 when the outside air temperature is substantially below 38° F.

Another embodiment of the present invention is illustrated in FIG. 4 wherein a main refrigeration enclosure 40 is connected to a plurality of satellite cooling enclosures 42. The main refrigeration enclosure 40 is cooled by existing refrigeration equipment and by the supplemental cold air supply unit 10 of the present invention. Each satellite cooling enclosure 42 is connected to the main enclosure by coaxial pipe assemblies 44 which provide cold air input and warm air exhaust. The coaxial pipe assemblies 44 are similar to coaxial pipe assembly 16 but additionally include fans 46 which blow cold air from the main enclosure into the satellite enclosures. Sensing units 50 in each satellite enclosure detect the need for additional cold air and open dampers 48 when cold air is required. At the same time, fans 46 are turned on and they blow cold air from the main enclosure into the satellite enclosures. The supplemental cold air supply unit of the present invention provides expanded capability for existing refrigeration enclosures whereby satellite cooling enclosures 42 may be incorporated without increasing the capacity of the existing refrigeration equipment or adding additional refrigeration equipment.

It will be apparent to those skilled in the art that the foregoing disclosure is exemplary in nature rather than limiting, the invention being limited only by the appended claims.

I claim:

1. A supplemental cold air supply system for supplying outside ambient air into a refrigeration enclosure when the outside air is at a temperature equal to or below the air temperature within the enclosure and when the outside air is at a temperature suitable for refrigeration purposes, said supply system comprising:

a housing being fastened to said refrigeration enclosure;

a blower being mounted within said housing, means for selectively actuating said blower to discharge cold air into said enclosure when the outside ambient air temperature is equal to or lower than the air temperature inside said enclosure;

a coaxial pipe assembly being mounted between said container and the outside of said frigeration enclosure, said assembly including a cold air inlet pipe and a warm air exhaust pipe, said warm air exhaust pipe being concentric with said cold air inlet pipe, said cold air inlet pipe having one end connected to the inlet of said blower for providing cold air to said blower;

said housing including a first pivotable door for exhausting the cold air discharged from said blower into said enclosure;

said housing including a second pivotable door for exhausting the warm air from said enclosure to the outside through said warm air exhaust, said second door being normally closed, means for automatically opening said second door when said blower is operating and discharging cold air into said enclosure through said first door;

said means for selectively actuating said blower including a first temperature responsive means mounted outside the refrigeration enclosure for detecting the ambient air temperature of the outside air and a second temperature responsive means mounted inside the enclosure for detecting the air temperature in the enclosure, said first temperature responsive means and said second temperature responsive means being electrically connected in series; and said means for automatically opening said second door including a motor having a rotatable cam arm, said cam arm being engageable with a cam follower mounted on said second door, said cam arm opening said door a predetermined amount in response to said blower being actuated, a first limit means for turning said motor off when said door is closed and a second limit means for turning said motor off when said door is opened to said predetermined amount.

2. The supplemental cold air supply system as defined in claim 1 including means for connecting a plurality of satellite cooling enclosures to said refrigeration enclosure, said cold air supply system supplying outside cold air into each of said satellite cooling enclosures.

* * * * *